US010457053B2

(12) United States Patent
Okuno et al.

(10) Patent No.: US 10,457,053 B2
(45) Date of Patent: Oct. 29, 2019

(54) INK JET PRINTER

(71) Applicant: Roland DG Corporation, Hamamatsu-shi, Shizuoka (JP)

(72) Inventors: Hiroshi Okuno, Hamamatsu (JP); Hideki Yagi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/041,862

(22) Filed: Jul. 23, 2018

(65) Prior Publication Data

US 2019/0030899 A1 Jan. 31, 2019

(30) Foreign Application Priority Data

Jul. 27, 2017 (JP) ..... 2017-145677

(51) Int. Cl.
*B41J 2/165* (2006.01)

(52) U.S. Cl.
CPC ..... *B41J 2/16538* (2013.01); *B41J 2/16541* (2013.01); *B41J 2/16547* (2013.01); *B41J 2/16552* (2013.01)

(58) Field of Classification Search
CPC ..... B41J 2/16538; B41J 2/16541; B41J 2/16547; B41J 2/16552
USPC ..... 347/33
See application file for complete search history.

(56) References Cited

U.S. PATENT DOCUMENTS

2006/0001710 A1* 1/2006 Lee ..... B41J 2/16538 347/86
2008/0286021 A1* 11/2008 Asami ..... B41J 2/16538 399/351
2017/0015101 A1* 1/2017 Coma Vives ..... B41J 2/16535

FOREIGN PATENT DOCUMENTS

JP 2006-095779 A 4/2006
JP 5242292 B2 7/2013
JP 5875729 B1 3/2016
JP 2017-043052 A 3/2017

* cited by examiner

*Primary Examiner* — Stephen D Meier
*Assistant Examiner* — Alexander D Shenderov
(74) *Attorney, Agent, or Firm* — Keating & Bennett, LLP

(57) ABSTRACT

A printer includes a first ink head including first nozzles arranged in a sub-scanning direction and a first nozzle surface on which the first nozzles are disposed, a second ink head disposed at a side of the first ink head in a main scanning direction and including second nozzles arranged in the sub-scanning direction and disposed partially at a position identical to a position of a portion of the first nozzles in the sub-scanning direction and a second nozzle surface on which the second nozzles are disposed, a first wiper that wipes the first nozzle surface at a first wiping position, and a second wiper that wipes the second nozzle surface at a second wiping position.

11 Claims, 10 Drawing Sheets

INK JET PRINTER

CROSS REFERENCE TO RELATED APPLICATIONS

This application claims the benefit of priority to Japanese Patent Application No. 2017-145677 filed on Jul. 27, 2017. The entire contents of this application are hereby incorporated herein by reference.

BACKGROUND OF THE INVENTION

1. Field of the Invention

The present invention relates to an ink jet printer.

2. Description of the Related Art

An ink jet printer known to date includes an ink head including a plurality of nozzles and a nozzle surface on which the nozzles are formed, and performs predetermined printing on a recording medium via an ink jet process. The ink jet printer includes a maintenance mechanism for cleaning adherents such as ink and foreign matter adhering to portions near nozzles of the ink head.

A known maintenance mechanism is, for example, a wiper for wiping a nozzle surface. When the wiper and the nozzle surface move relative to each other with the wiper being in contact with the nozzle surface, an adherent to the nozzle surface is wiped off by the wiper. In this manner, solidification of ink and other substances on the ink surface can be prevented so that a failure in discharging ink can be prevented. After wiping of the nozzle surface, ink adheres to the wiper. It is known to remove ink from the wiper by supplying the wiper with a cleaning solution.

Here, after removal of ink adhering to the wiper with the cleaning solution, the cleaning solution still remains on the wiper in some cases. In this state, when the wiper wipes the nozzle surface, the cleaning solution might adhere to the nozzle surface. In the case of performing printing on a recording medium with the cleaning solution adhering to the nozzle surface, the cleaning solution might smear the recording medium. In view of this, Japanese Patent No. 5875729, for example, discloses a technique of removing a cleaning solution remaining on the wiper with a pad having absorbency.

As a printer on which a plurality of ink heads are arranged side by side, a printer having a so-called stagger arrangement in which one ink head is shifted from other ink heads in a sub-scanning direction that is a conveying direction of a recording medium is known. In the case where the ink heads are arranged in a staggered pattern, a wiper capable of efficiently wiping each nozzle surface is demanded.

SUMMARY OF THE INVENTION

Preferred embodiments of the present invention provide ink jet printers each including a wiper that efficiently wipes nozzle surfaces of ink heads in a staggered pattern.

An ink jet printer according to a preferred embodiment of the present invention includes: a first ink head including a plurality of first nozzles arranged in a first direction and a first nozzle surface on which the first nozzles are disposed; a second ink head disposed at a side of the first ink head in a second direction perpendicular to the first direction, the second ink head including a plurality of second nozzles arranged in the first direction and a second nozzle surface on which the second nozzles are disposed, a portion of the second nozzles being disposed at a position identical to a portion of the first nozzles in the first direction, the second ink head being shifted from the first ink head in the first direction; a third ink head disposed at a side of the second ink head opposite to the first ink head in the second direction and at a position identical to a position of the first ink head in the first direction, the third ink head including a plurality of third nozzles arranged in the first direction and a third nozzle surface on which the third nozzles are disposed, the third nozzles being disposed at a position identical to a position of the first nozzles in the first direction; a fourth ink head disposed at a side of the third ink head opposite to the second ink head in the second direction and at a position identical to a position of the second ink head in the first direction, the fourth ink head including a plurality of fourth nozzles arranged in the first direction and a fourth nozzle surface on which the fourth nozzles are disposed, a portion of the fourth nozzles being disposed at a position identical to the position of the second nozzles in the first direction; a first wiper extending in the first direction and structured to wipe the first nozzle surface and the third nozzle surface at a predetermined first position; a second wiper extending in the first direction, disposed at a side of the first wiper in the second direction and disposed partially at a position identical to a position of the first wiper in the first direction, structured to pivot to an angle identical to an angle of the first wiper and to wipe the second nozzle surface and the fourth nozzle surface at a predetermined second position; a cleaner that supplies a cleaning solution to the first wiper at a predetermined third position and supplies the cleaning solution to the second wiper at a predetermined fourth position at an identical time; a remover that removes the cleaning solution remaining on the first wiper at a predetermined fifth position and removes the cleaning solution remaining on the second wiper at a predetermined sixth position at an identical time; a first driver that moves the first wiper to the first position, the third position, and the fifth position; and a second driver that moves the second wiper to the second position, the fourth position, and the sixth position.

In an ink jet printer according to a preferred embodiment of the present invention, the first ink head and the third ink head are disposed at the same position in the first direction and the second ink head and the fourth ink head are disposed at the same position in the first direction, but the first ink head and the third ink head are shifted from the second ink head and the fourth ink head in the first direction. In this example, the ink jet printer includes the first wiper to wipe the first nozzle surface and the third nozzle surface and the second wiper to wipe the second nozzle surface and the fourth nozzle surface, and thus ensure wiping of the nozzle surfaces. In the case of providing a single wiper that is relatively long in the first direction enough to wipe the first nozzle surface through the fourth nozzle surface, the wiper needs to be immersed in the cleaning solution for every wiping of the nozzle surfaces, and the step of removing the cleaning solution is needed every wiping. Thus, as the number of ink heads increases, the time necessary to perform wiping increases. On the other hand, in the case of including the first wiper and the second wiper, since the first wiper and the second wiper pivot by the same angle, in supplying the cleaning solution to the first wiper, the cleaning solution is supplied to the second wiper at the same time. In removing the cleaning solution remaining on the first wiper, the cleaning solution remaining on the second wiper is removed at the same time. Thus, the time necessary for wiping is reduced, as compared to the case of including a single wiper.

According to preferred embodiments of the present invention, ink jet printers include wipers capable of efficiently wiping nozzle surfaces of ink heads arranged in a staggered pattern.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
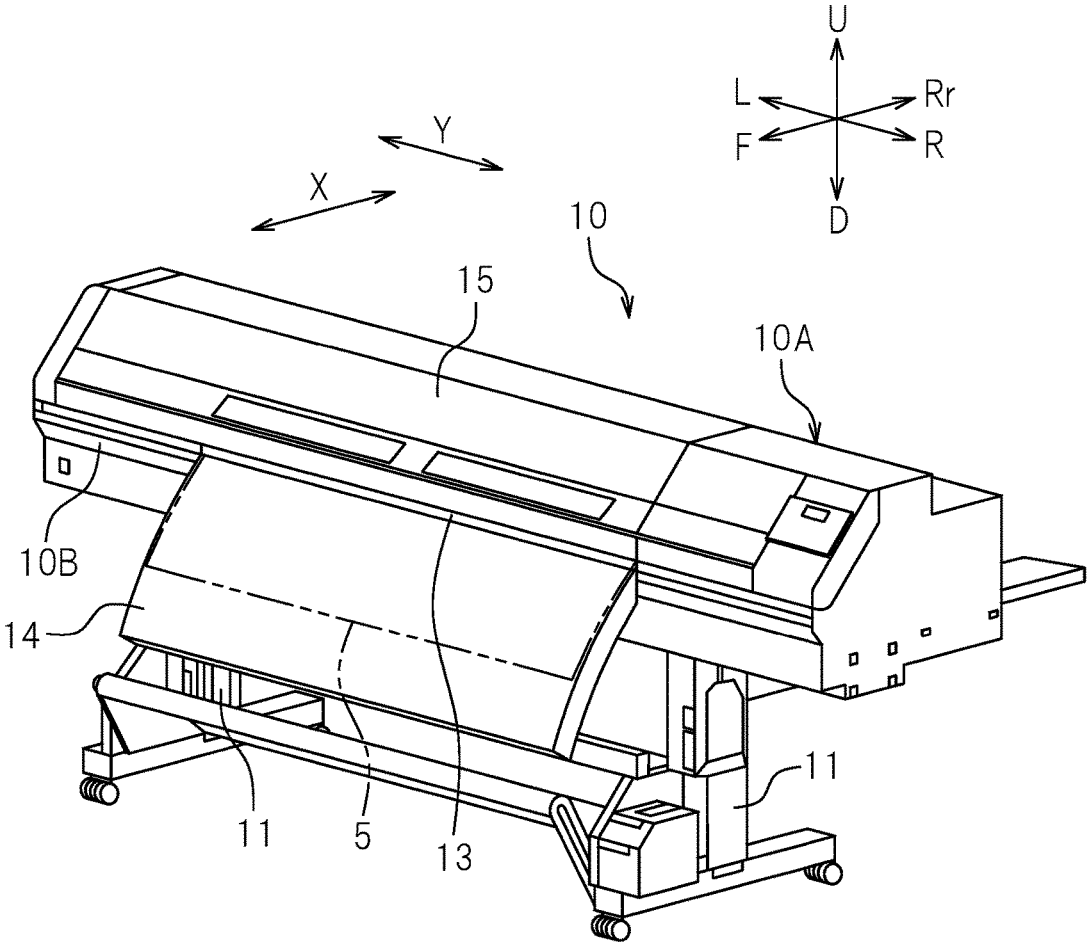
FIG. 1 is a perspective view illustrating a printer according to a preferred embodiment of the present invention.

Ink jet printers (hereinafter simply referred to as a "printer" or "printers") according to preferred embodiments of the present invention will be described hereinafter with reference to the drawings. The preferred embodiments described here are, of course, not intended to particularly limit the present invention. Elements and features having the same functions are denoted by the same reference characters, and description for the same members and parts will not be repeated or will be simplified as appropriate.

Figure 2:
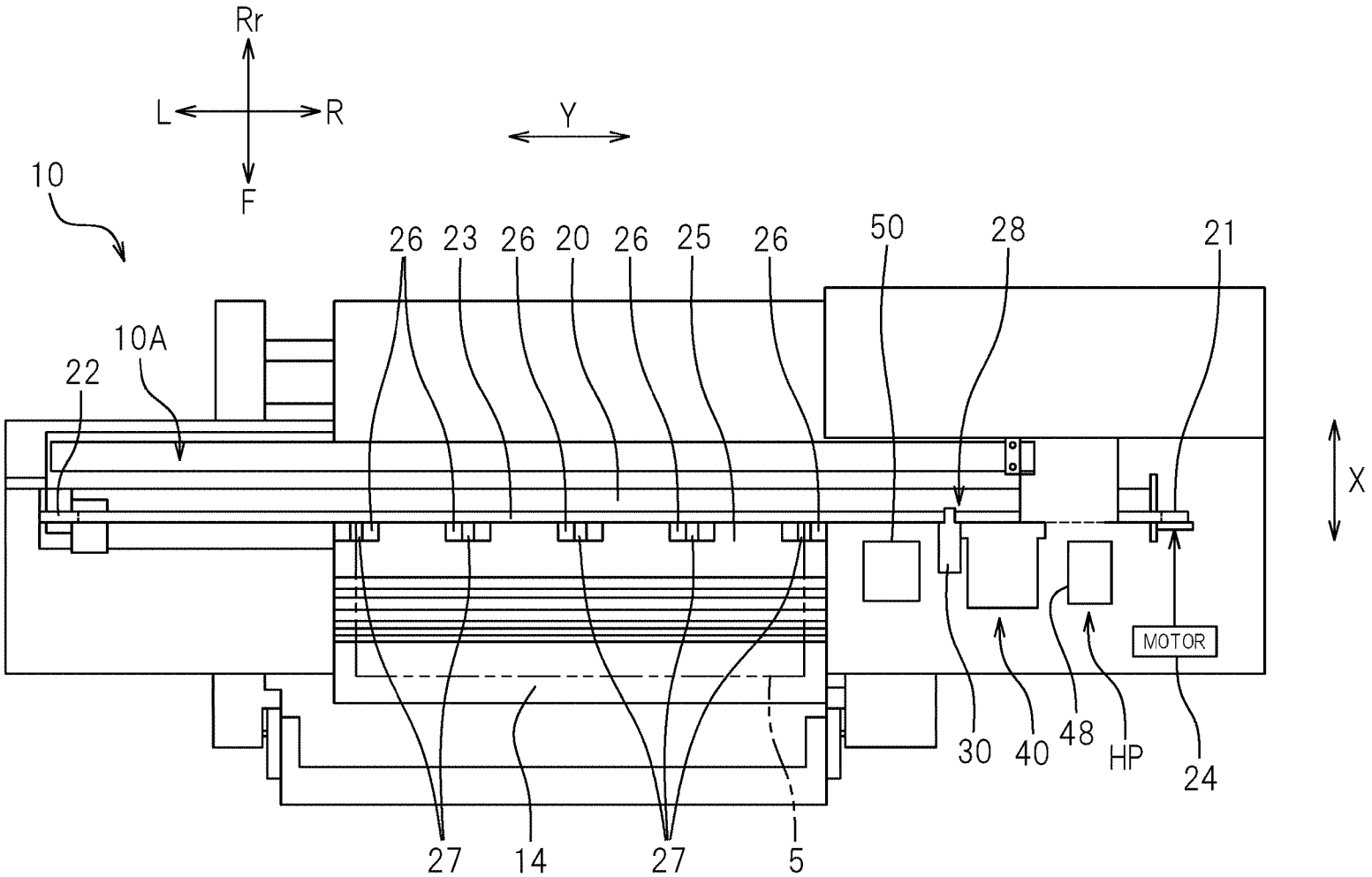
FIG. 2 is a plan view illustrating an internal configuration of a printer according to a preferred embodiment of the present invention.

FIG. 1 is a perspective view of a printer 10 according to a preferred embodiment of the present invention. FIG. 2 is a plan view illustrating an internal configuration of the printer 10. As illustrated in FIG. 1, the printer 10 performs printing on a recording medium 5. The recording medium 5 is, for example, a recording sheet. The recording medium 5, however, is not limited to the recording sheet. The recording medium 5 is not limited to paper sheets such as plain paper or ink jet printing paper, and may be a resin sheet or a resin film of, for example, polyvinyl chloride or polyester, fabrics such as a woven fabric or a nonwoven fabric, or other media.

In the following description, left, right, up, and down respectively refer to left, right, up, and down seen from an operator at the front of the printer 10. The direction toward the operator from the printer 10 will be hereinafter referred to as forward, and the opposite direction away from the operator will be hereinafter referred to as rearward. Characters F, Rr, L, R, U, and D in the drawings represent front, rear, left, right, up, and down, respectively. An ink head unit 40 (see FIG. 2) described later is movable to the left and right. The recording medium 5 is able to be conveyed forward and rearward. In this preferred embodiment, a direction in which the ink head unit 40 moves will be referred to as a main scanning direction Y, and a conveying direction of the recording medium 5 will be referred to as a sub-scanning direction X. In this example, the main scanning direction Y corresponds to the left-right direction, and the sub-scanning direction X corresponds to the front-rear direction. The main scanning direction Y and the sub-scanning direction X are orthogonal to each other. The main scanning direction Y and the sub-scanning direction X are not limited to specific directions, and can be set at any directions in accordance with the state of the printer 10, for example. In this preferred embodiment, the direction in which a first nozzle surface 43A, for example, (see FIG. 4) is wiped refers to the left-right direction (i.e., the main scanning direction Y). The direction in which the first nozzle surface 43A, for example, is wiped may be the front-rear direction (i.e., the sub-scanning direction X).

As illustrated in FIG. 1, the printer 10 includes a body 10A, legs 11, and a cover 15. The body 10A includes a casing 10B extending in the main scanning direction Y. The legs 11 support the body 10A. The legs 11 are disposed on the lower surface of the body 10A. The cover 15 is provided to the body 10A. In this example, the cover 15 is attached to an upper portion of the body 10A so that the cover 15 is able to be freely opened and closed. A lower portion of the body 10A below the cover 15 includes an outlet 13 from which the recording medium 5 is ejected. A guide 14 to guide the recording medium 5 that is being ejected from the outlet 13 is disposed in front of and below the outlet 13. The guide 14 extends obliquely forward and downward from the outlet 13.

Figure 3:
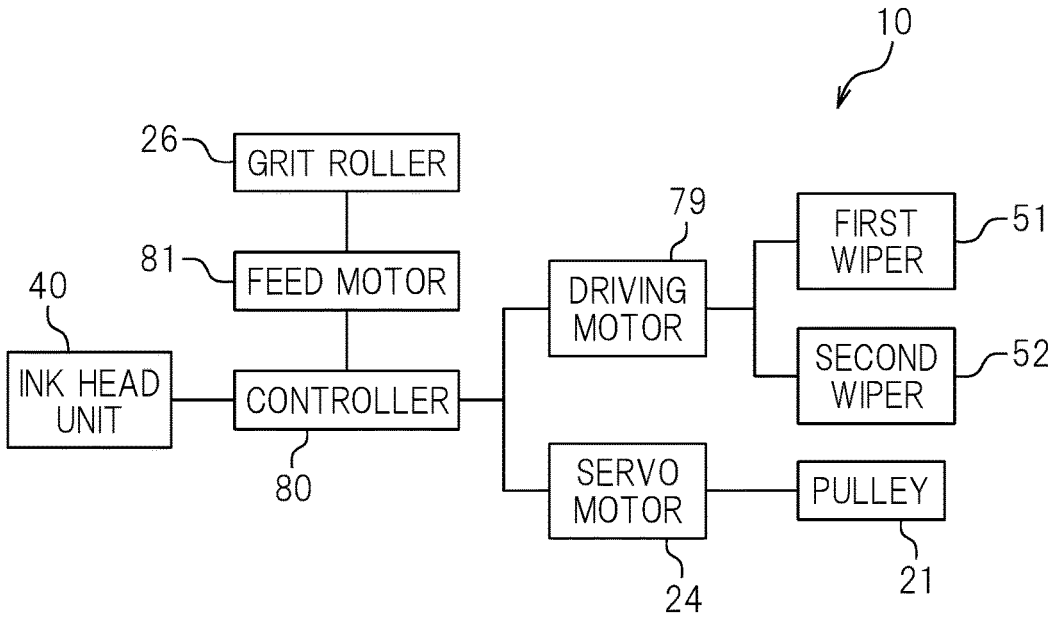
FIG. 3 is a block diagram of a printer according to a preferred embodiment of the present invention.

As illustrated in FIG. 2, the printer 10 includes a guide rail 20, a platen 25, a head driver 28, an ink head unit 40, a wiping unit 50, and a controller 80 (see FIG. 3). The guide rail 20 is disposed below the cover 15. The guide rail 20 extends in the main scanning direction Y.

The recording medium 5 is placed on the platen 25. The platen 25 supports the recording medium 5. Printing on the recording medium 5 is performed on the platen 25. The platen 25 extends in the main scanning direction Y. The platen 25 is disposed below and ahead of a center portion of the guide rail 20. The platen 25 is continuous to the guide 14.

The platen 25 is provided with cylindrical grit rollers 26 defining a moving mechanism. The grit rollers 26 are buried in the platen 25 with the upper surfaces of the grit rollers 26 being exposed. The grit rollers 26 are driven by a feed motor 81 (see FIG. 3).

A plurality of pinch rollers 27 are disposed above the grit rollers 26 at regular or substantially regular intervals. The pinch rollers 27 face the grit rollers 26. The positions of the pinch rollers 27 in the top-bottom direction are able to be set depending on the thickness of the recording medium 5. The recording medium 5 is pinched between the pinch rollers 27 and the grit rollers 26. The grit rollers 26 and the pinch rollers 27 convey the recording medium 5 in the sub-scanning direction X while pinching the recording medium 5 therebetween.

The head driver 28 moves the ink head unit 40 in the main scanning direction Y. In this example, the head driver 28 includes a pulley 21, a pulley 22, an endless belt 23, a servo motor 24, and a carriage 30. The pulley 21 is disposed at the right end of the guide rail 20. The pulley 22 is disposed at the left end of the guide rail 20. The belt 23 is wound around the pulley 21 and the pulley 22. In this example, the servo motor 24 is connected to the pulley 21, but may be connected to the pulley 22. When the servo motor 24 drives the pulley 21, the belt 23 travels between the pulley 21 and the pulley 22.

The carriage 30 is attached to the belt 23. Although not shown, the carriage 30 is engaged with the guide rail 20. The carriage 30 moves in the main scanning direction Y along the guide rail 20 with traveling of the belt 23.

Figure 4:
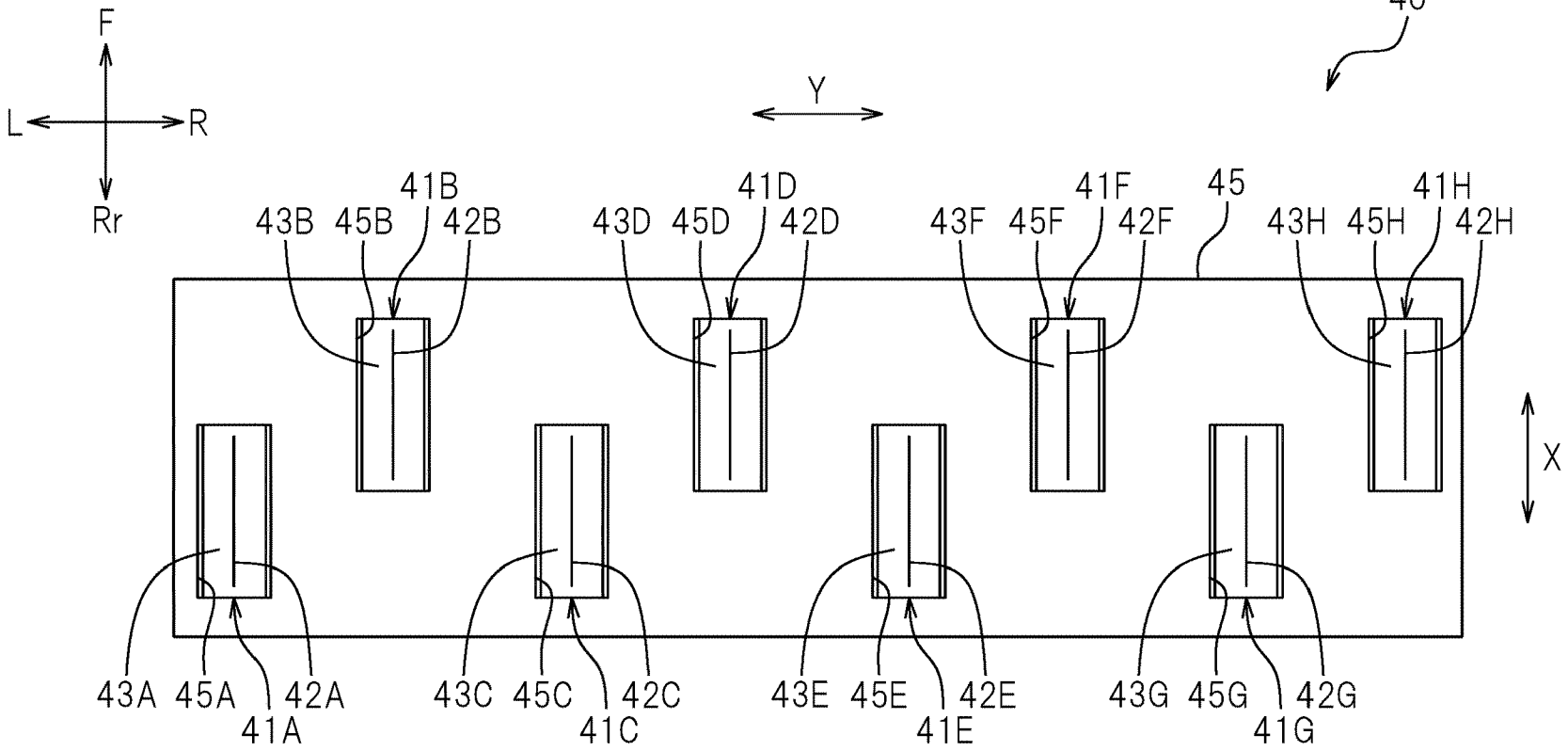
FIG. 4 is a bottom view of an ink head unit according to a preferred embodiment of the present invention.

The ink head unit 40 is disposed above the platen 25. As illustrated in FIG. 4, the ink head unit 40 includes a first ink head 41A, a second ink head 41B, a third ink head 41C, a fourth ink head 41D, a fifth ink head 41E, a sixth ink head 41F, a seventh ink head 41G, an eighth ink head 41H, and a head plate 45. The head plate 45 is disposed on the carriage 30. The first ink head 41A through the eighth ink head 41H are housed in the head plate 45. The head plate 45 houses the first ink head 41A through the eighth ink head 41H in such a manner that a first nozzle surface 43A through an eighth nozzle surface 43H described later of the first ink head 41A through the eighth ink head 41H are exposed to the outside. The ink head unit 40 is slidably engaged with the guide rail 20 with the carriage 30 interposed therebetween. The ink head unit 40 is caused to move by the head driver 28 in the main scanning direction Y along the guide rail 20.

The first ink head 41A through the eighth ink head 41H discharge ink onto the recording medium 5. The first ink head 41A through the eighth ink head 41H discharge ink from first nozzles 42A through eighth nozzles 42H described later (see FIG. 4). As illustrated in FIG. 4, the first ink head 41A through the eighth ink head 41H are longer in the sub-scanning direction X (front-rear direction) than in the main scanning direction Y (left-right direction). The first ink head 41A through the eighth ink head 41H preferably have the same shape and the same size, for example. The first ink head 41A, the third ink head 41C, the fifth ink head 41E, and the seventh ink head 41G are located at the same position in the sub-scanning direction X. The second ink head 41B, the fourth ink head 41D, the sixth ink head 41F, and the eighth ink head 41H are located at the same position in the sub-scanning direction X. The front ends of the first ink head 41A, the third ink head 41C, the fifth ink head 41E, and the seventh ink head 41G are located behind the front ends of the second ink head 41B, the fourth ink head 41D, the sixth ink head 41F, and the eighth ink head 41H, and ahead of the rear ends of the second ink head 41B, the fourth ink head 41D, the sixth ink head 41F, and the eighth ink head 41H. The first ink head 41A through the eighth ink head 41H are arranged in a staggered pattern. The first ink head 41A through the eighth ink head 41H are arranged at regular intervals in the main scanning direction Y.

As illustrated in FIG. 4, the first ink head 41A includes a plurality of first nozzles 42A arranged in the sub-scanning direction X and a first nozzle surface 43A on which the first nozzles 42A are provided. The second ink head 41B includes a plurality of second nozzles 42B arranged in the sub-scanning direction X and a second nozzle surface 43B on which the second nozzles 42B are provided. The second ink head 41B is disposed at a side of the first ink head 41A in the main scanning direction Y. The second ink head 41B is disposed at the right of the first ink head 41A. The second ink head 41B is shifted from the first ink head 41A in the sub-scanning direction X. The front end of the second ink head 41B is located ahead of the front end of the first ink head 41A. The rear end of the second ink head 41B is located behind the front end of the first ink head 41A and ahead of the rear end of the first ink head 41A. With respect to the sub-scanning direction X, a portion of the second nozzles 42B is located at the same position as a portion of the first nozzles 42A. The third ink head 41C includes a plurality of third nozzles 42C arranged in the sub-scanning direction X and a third nozzle surface 43C on which the third nozzles 42C are provided. The third ink head 41C is disposed at a side of the second ink head 41B opposite to the first ink head 41A. The third ink head 41C is disposed at the right of the second ink head 41B. With respect to the sub-scanning direction X, the third nozzles 42C are located at the same position as the first nozzles 42A. The fourth ink head 41D includes a plurality of fourth nozzles 42D arranged in the sub-scanning direction X and a fourth nozzle surface 43D on which the fourth nozzles 42D are provided. The fourth ink head 41D is disposed at a side of the third ink head 41C opposite to the second ink head 41B. The fourth ink head 41D is located at the right of the third ink head 41C. With respect to the sub-scanning direction X, the fourth nozzles 42D are located at the same position as the second nozzles 42B. The fifth ink head 41E includes a plurality of fifth nozzles 42E arranged in the sub-scanning direction X and a fifth nozzle surface 43E on which the fifth nozzles 42E are provided. The fifth ink head 41E is disposed at a side of the fourth ink head 41D opposite to the third ink head 41C. The fifth ink head 41E is disposed at the right of the fourth ink head 41D. With respect to the sub-scanning direction X, the fifth nozzles 42E are disposed at the same position as the first nozzles 42A. The sixth ink head 41F includes a plurality of sixth nozzles 42F arranged in the sub-scanning direction X and a sixth nozzle surface 43F on which the sixth nozzles 42F are provided. The sixth ink head 41F is disposed at a side of the fifth ink head 41E opposite to the fourth ink head 41D. The sixth ink head 41F is disposed at the right of the fifth ink head 41E. With respect to the sub-scanning direction X, the sixth nozzles 42F are disposed at the same position as the second nozzles 42B. The seventh ink head 41G includes a plurality of seventh nozzles 42G arranged in the sub-scanning direction X and a seventh nozzle surface 43G on which the seventh nozzles 42G are provided. The seventh ink head 41G is disposed at a side of the sixth ink head 41F opposite to the fifth ink head 41E. The seventh ink head 41G is disposed at the right of the sixth ink head 41F. With respect to the sub-scanning direction X, the seventh nozzles 42G are located at the same position as the first nozzles 42A. The eighth ink head 41H includes a plurality of eighth nozzles 42H arranged in the sub-scanning direction X and an eighth nozzle surface 43H on which the eighth nozzles 42H are provided. The eighth ink head 41H is disposed at a side of the seventh ink head 41G opposite to the sixth ink head 41F. The eighth ink head 41H is disposed at the right of the seventh ink head 41G. With respect to the sub-scanning direction X, the eighth nozzles 42H are located at the same position as the second nozzles 42B. The first nozzles 42A through the eighth nozzles 42H discharge ink onto the recording medium 5. The first nozzles 42A through the eighth nozzles 42H are set at a negative pressure (pressure lower than an atmospheric pressure). Since the first nozzles 42A through the eighth nozzles 42H are minute, FIG. 4 represents the first nozzles 42A through the eighth nozzles 42H by straight lines. In this preferred embodiment, each of the first ink head 41A through the eighth ink head 41H includes one type of nozzles, but may include two or more types of nozzles.

As illustrated in FIG. 4, the head plate 45 includes a first opening 45A, a second opening 45B, a third opening 45C, a fourth opening 45D, a fifth opening 45E, a sixth opening 45F, a seventh opening 45G, and an eighth opening 45H arranged in the main scanning direction Y. The first opening 45A through the eighth opening 45H are longer in the sub-scanning direction X than in the main scanning direction Y. The first opening 45A through the eighth opening 45H preferably have the same shape and the same size, for example. The first opening 45A, the third opening 45C, the fifth opening 45E, and the seventh opening 45G are located at the same position in the sub-scanning direction X. The second opening 45B, the fourth opening 45D, the sixth opening 45F, and the eighth opening 45H are located at the same position in the sub-scanning direction X. The front ends of the first opening 45A, the third opening 45C, the fifth opening 45E, and the seventh opening 45G are located behind the front ends of the second opening 45B, the fourth opening 45D, the sixth opening 45F, and the eighth opening 45H and ahead of the rear ends of the second opening 45B, the fourth opening 45D, the sixth opening 45F, and the eighth opening 45H. The first ink head 41A through the eighth ink head 41H are respectively attached to the first opening 45A through the eighth opening 45H. The first ink head 41A through the eighth ink head 41H are respectively attached to the first opening 45A through the eighth opening 45H in such a manner that the first nozzle surface 43A through the eighth nozzle surface 43H are located below the head plate 45. The first nozzles 42A through the eighth nozzles 42H are located inside the first opening 45A through the eighth opening 45H when seen from below.

In the present preferred embodiment, the ink head unit 40 is held at a home position HP in the right end of the guide rail 20 while printing is not performed on the recording medium 5 or before wiping is started. The head driver 28 moves the ink head unit 40 to the home position HP. The home position HP is not limited to a specific location, but is preferably at a location except the platen 25 in plan view. The home position HP may be at the left end of the guide rail 20, for example.

In this preferred embodiment, a capping unit 48 is disposed at the home position HP in a lower right end portion of the body 10A. The ink head unit 40 is located above the capping unit 48 when the ink head unit 40 is held at the home position HP. The capping unit 48 includes unillustrated caps that cover the first nozzle surface 43A through the eighth nozzle surface 43H while the ink head unit 40 is at the home position HP. The caps cover the first nozzle surface 43A through the eighth nozzle surface 43H to significantly reduce or prevent drying of the first nozzles 42A through the eighth nozzles 42H. Ink in the first nozzles 42A through the eighth nozzles 42H is discharged into the caps by an unillustrated suction pump. In this manner, clogging of the first nozzles 42A through the eighth nozzles 42H is significantly reduced or prevented.

Figure 5:
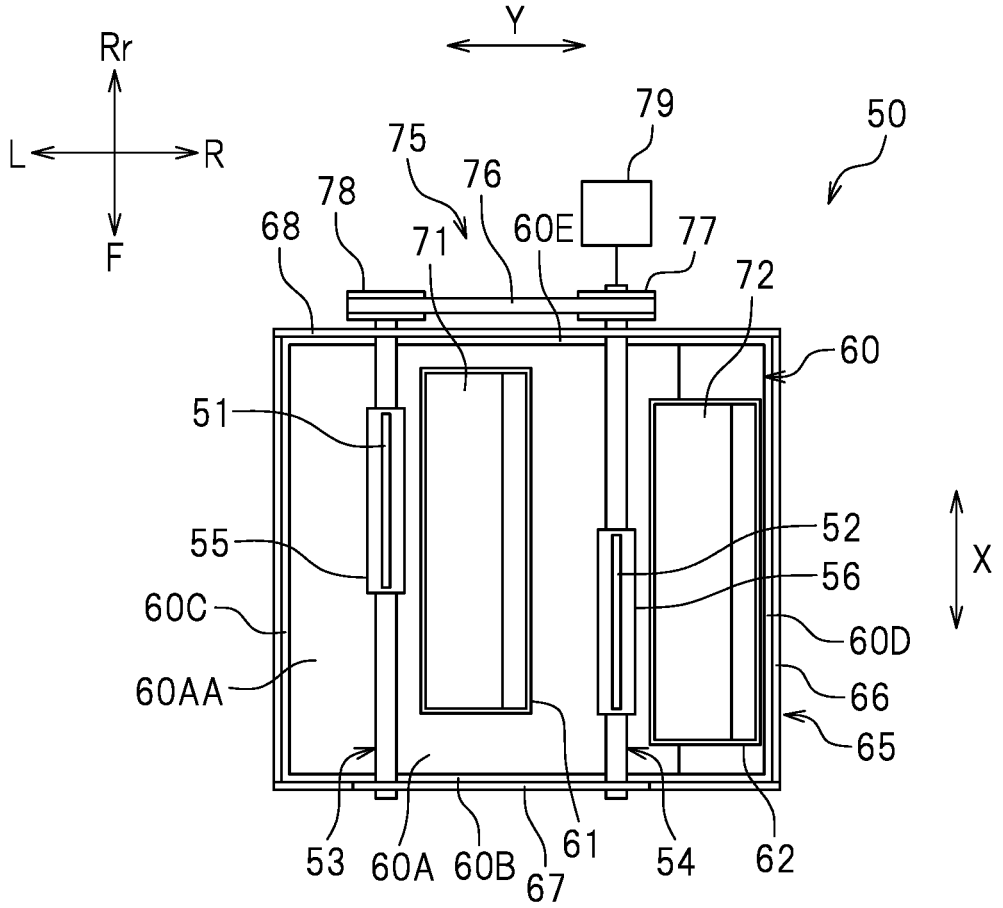
FIG. 5 is a plan view of a wiping unit according to a preferred embodiment of the present invention.

Next, the wiping unit 50 according to this preferred embodiment will be described. When printing is performed by the printer 10, an adherent such as ink or foreign matter adheres to the first nozzle surface 43A through the eighth nozzle surface 43H in some cases. If printing is performed in the presence of this adherent, the recording medium 5 may be smudged to degrade print quality in some cases. To prevent this, the wiping unit 50 removes the adherent such as ink adhering to the first nozzle surface 43A through the eighth nozzle surface 43H. As illustrated in FIG. 2, the wiping unit 50 is disposed inside the printer 10. In this example, the wiping unit 50 is disposed between the platen 25 and the capping unit 48. As illustrated in FIG. 5, the wiping unit 50 includes a body 65, a cleaning solution tank 60, a first shaft 53, a first wiper 51, a second shaft 54, a second wiper 52, a first remover 71, a second remover 72, and a driver 75.

As illustrated in FIG. 5, the body 65 includes a support base 66, a front plate 67, and a rear plate 68. The cleaning solution tank 60 is placed on the support base 66. The support base 66 is fixed to the body 10A (see FIG. 2). The front plate 67 extends upward from the front end of the support base 66. The rear plate 68 extends upward from the rear end of the support base 66.

As illustrated in FIG. 5, the first shaft 53 extends in the sub-scanning direction X. The first shaft 53 is pivotably supported by the front plate 67 and the rear plate 68. The first shaft 53 pivotably supports a first holder 55 holding the first wiper 51. The second shaft 54 extends in the sub-scanning direction X. The second shaft 54 is pivotably supported by the front plate 67 and the rear plate 68. The second shaft 54 pivotably supports a second holder 56 holding the second wiper 52. The second shaft 54 is separated from the first shaft 53. The second shaft 54 is disposed at the right of the first shaft 53. The second shaft 54 is parallel or substantially parallel with the first shaft 53. The first shaft 53 and the second shaft 54 are located above the cleaning solution tank 60 when the cleaning solution tank 60 is placed on the support base 66.

Figure 6:
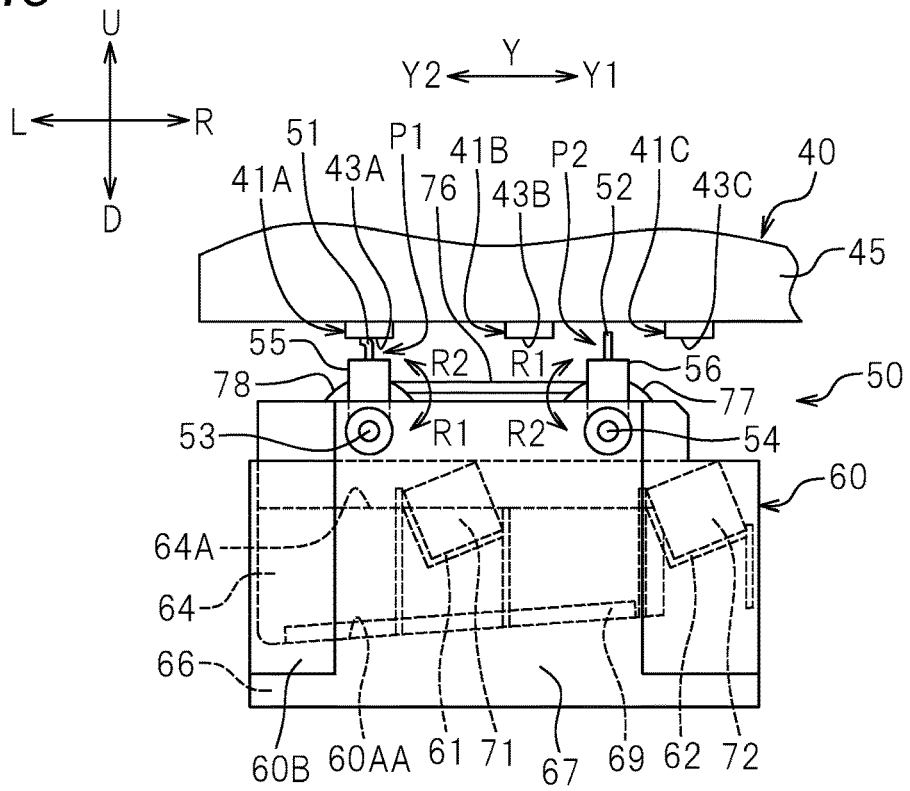
FIG. 6 is a schematic view illustrating a state in which a first wiper wipes a first nozzle surface at a first wiping position.

As illustrated in FIG. 5, the first wiper 51 extends in the sub-scanning direction X. The first wiper 51 is pivotably supported by the first shaft 53 with the first holder 55 interposed therebetween. The first wiper 51 is interchangeably held by the first holder 55. As illustrated in FIG. 6, the first wiper 51 wipes the first nozzle surface 43A, the third nozzle surface 43C, the fifth nozzle surface 43E (see FIG. 4), and the seventh nozzle surface 43G (see FIG. 4) at the first wiping position P1. The first wiper 51 sequentially wipes the first nozzle surface 43A, the third nozzle surface 43C, the fifth nozzle surface 43E, and the seventh nozzle surface 43G to remove adherents to the nozzle surfaces 43A, 43C, 43E, and 43G. The first wiping position P1 is an example of a "predetermined first position." In this example, at the first wiping position P1, the tip of the first wiper 51 sequentially contacts the surfaces such as the first nozzle surface 43A. When the tip of the first wiper 51 contacts the first nozzle surface 43A or other surfaces, the tip of the first wiper 51 is bent. Then, with the tip of the first wiper 51 being in contact with the first nozzle surface 43A, the ink head unit 40 moves in the main scanning direction Y (e.g., the direction indicated by arrow Y1 in FIG. 6) so that adherents to the first nozzle surface 43A and other surfaces are removed by the first wiper 51. The adherents removed from the first nozzle surface 43A and other surfaces typically adhere to the first wiper 51.

Figure 7:
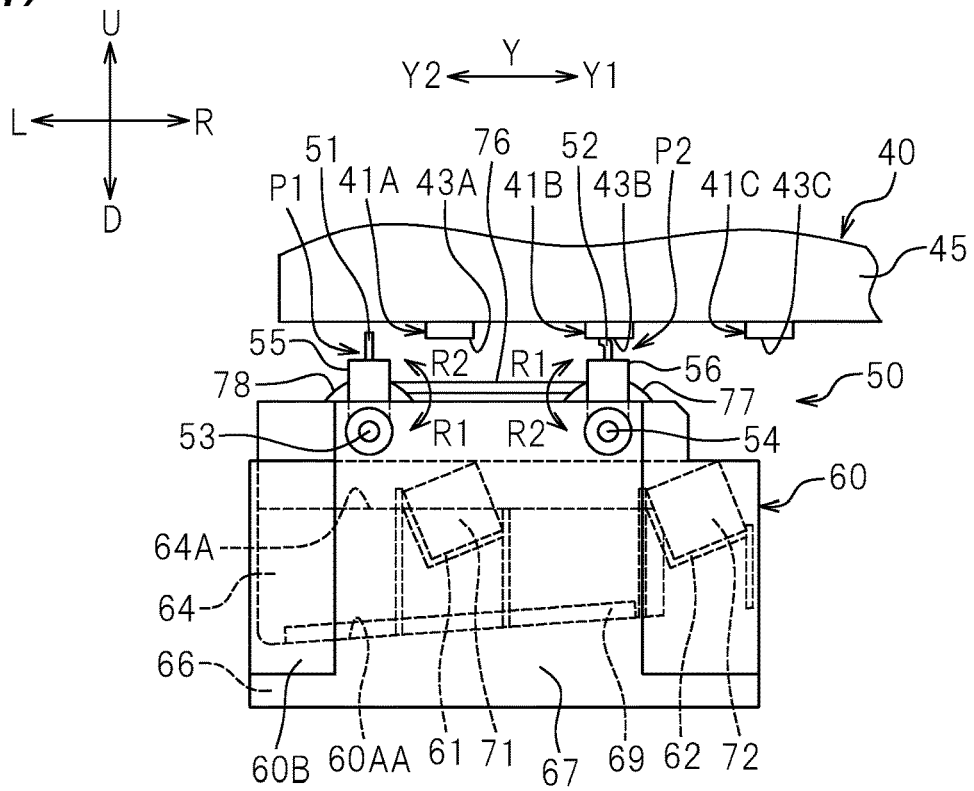
FIG. 7 is a schematic view illustrating a state in which a second wiper wipes a second nozzle surface at a second wiping position.

As illustrated in FIG. 5, the second wiper 52 extends in the sub-scanning direction X. The second wiper 52 has the same configuration as that of the first wiper 51. The second wiper 52 is disposed at a side of the first wiper 51 in the main scanning direction Y. The second wiper 52 is disposed at the right of the first wiper 51. The second wiper 52 is shifted from the first wiper 51 in the sub-scanning direction X. The front end of the second wiper 52 is located ahead of the front end of the first wiper 51. The rear end of the second wiper 52 is located behind the front end of the first wiper 51 and ahead of the rear end of the first wiper 51. A portion of the second wiper 52 is located at the same position as a portion of the first wiper 51 with respect to the sub-scanning direction X. The second wiper 52 is pivotably supported by the second shaft 54 with the second holder 56 interposed therebetween. The second wiper 52 pivots to the same angle as the first wiper 51. For example, when the second wiper 52 is at a second wiping position P2 (see FIG. 6), the first wiper 51 is at the first wiping position P1 (see FIG. 6). The second wiper 52 is interchangeably held by the second holder 56. As illustrated in FIG. 7, the second wiper 52 wipes the second nozzle surface 43B, the fourth nozzle surface 43D (see FIG. 4), the sixth nozzle surface 43F (see FIG. 4), and the eighth nozzle surface 43H (see FIG. 4) at the second wiping position P2. The second wiper 52 sequentially wipes the second nozzle surface 43B, the fourth nozzle surface 43D, the sixth nozzle surface 43F, and the eighth nozzle surface 43H to remove adherents to the nozzle surfaces 43B, 43D, 43F, and 43H. The second wiping position P2 is an example of a "predetermined second position." In this example, at the second wiping position P2, the tip of the second wiper 52 sequentially contacts the surfaces such as the second nozzle surface 43B. When the tip of the second wiper 52 contacts the second nozzle surface 43B or other surfaces, the tip of the second wiper 52 is bent. Then, with the tip of the second wiper 52 being in contact with the second nozzle surface 43B, the ink head unit 40 moves in the main scanning direction Y (e.g., the direction indicated by arrow Y1 in FIG. 7) so that adherents to the second nozzle surface 43B and other surfaces are thereby removed by the second wiper 52. The adherents removed from the second nozzle surface 43B and other surfaces typically adhere to the second wiper 52. The first wiper 51 and the second wiper 52 are not limited to specific materials, but are preferably made of flexible materials. For example, the first wiper 51 and the second wiper 52 are made of rubber.

The cleaning solution tank 60 stores a cleaning solution 64. The cleaning solution 64 is a solution used to clean the first wiper 51 and the second wiper 52. The cleaning solution 64 is not limited to a specific type. As the cleaning solution 64, water or an organic solvent, for example, can be used as appropriate. The cleaning solution tank 60 is an example of a cleaner. The cleaning solution tank 60 is detachable from the support base 66.

As illustrated in FIG. 5, the cleaning solution tank 60 preferably has a rectangular or substantially rectangular shape, for example. The cleaning solution tank 60 includes a bottom wall 60A, a front wall 60B, a left wall 60C, a right wall 60D, and a rear wall 60E. The front wall 60B extends upward from the front end of the bottom wall 60A. The left wall 60C extends upward from the left end of the bottom wall 60A. The right wall 60D extends upward from the right end of the bottom wall 60A. The rear wall 60E extends upward from the rear end of the bottom wall 60A. The bottom wall 60A, the front wall 60B, the left wall 60C, the right wall 60D, and the rear wall 60E define a space in which the cleaning solution 64 is stored. As illustrated in FIG. 6, an upper surface 60AA of the bottom wall 60A (see FIG. 5) tilts toward the lower left. The cleaning solution tank 60 includes a first placing member 61 and a second placing member 62. The first placing member 61 and the second placing member 62 extend upward from the bottom wall 60A. The first placing member 61 and the second placing member 62 prevent the cleaning solution 64 from flowing onto the first placing member 61 and the second placing member 62. That is, the upper ends of the first placing member 61 and the second placing member 62 are located above a liquid level 64A of the cleaning solution 64. On the first placing member 61, the first remover 71 is interchangeably placed. On the second placing member 62, the second remover 72 is interchangeably placed.

As illustrated in FIG. 6, at least a portion of the upper surface 60AA of the bottom wall 60A of the cleaning solution tank 60 is provided with a filter 69. The filter 69 is a filter to which adherents removed from the first wiper 51 and the second wiper 52 adhere when the first wiper 51 and the second wiper 52 are cleaned with the cleaning solution 64 stored in the cleaning solution tank 60. In this example, an adherent removed in the cleaning solution tank 60 moves downward and is precipitated in the cleaning solution tank 60. The precipitated adherent adheres to the filter 69. The filter 69 is not limited to a specific material. For example, the filter 69 is preferably a porous polyethylene-based fibrous filter.

Figure 8:
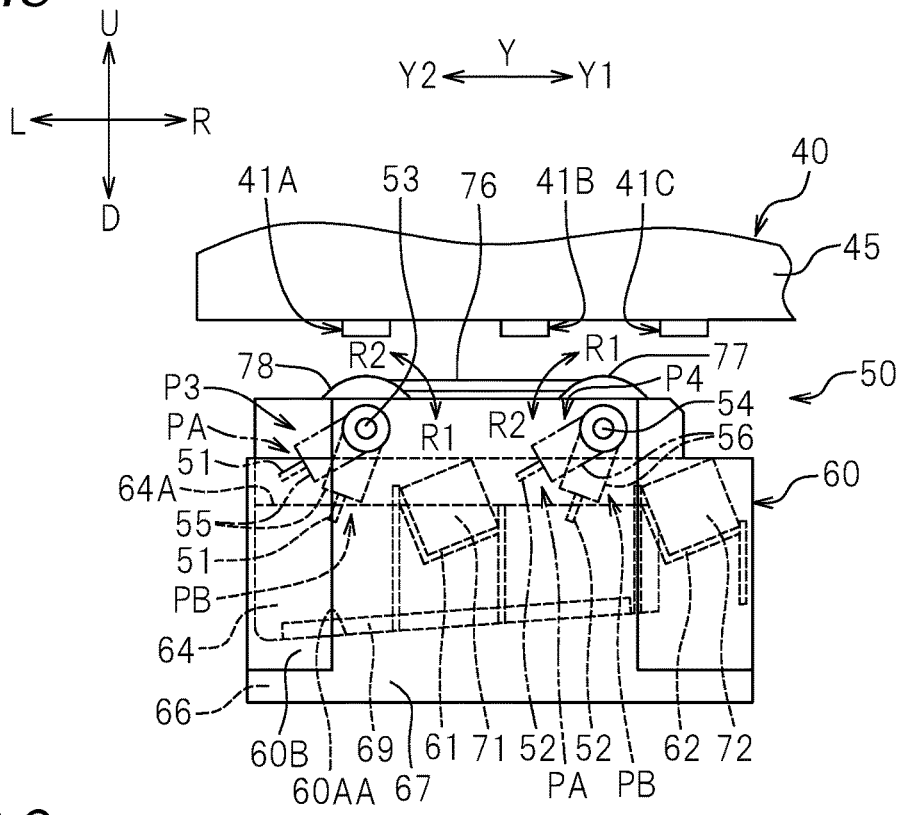
FIG. 8 is a schematic view illustrating positions of the first wiper and the second wiper at a first cleaning position and a second cleaning position.

As illustrated in FIG. 8, at a first cleaning position P3, the first wiper 51 is immersed in the cleaning solution 64 stored in the cleaning solution tank 60. At least a portion of the first wiper 51 that has contacted the first nozzle surface 43A and other surfaces in wiping is immersed in the cleaning solution 64. Through the immersion of the first wiper 51 in the cleaning solution 64, an adherent to the first wiper 51 is removed. The first cleaning position P3 is an example of a "predetermined third position."

As illustrated in FIG. 8, at a second cleaning position P4, the second wiper 52 is immersed in the cleaning solution 64 stored in the cleaning solution tank 60. At least a portion of the second wiper 52 that has contacted the second nozzle surface 43B and other surfaces in wiping is immersed in the cleaning solution 64. Through the immersion of the second wiper 52 in the cleaning solution 64, an adherent to the second wiper 52 is removed. The second cleaning position P4 is an example of a "predetermined fourth position." In this preferred embodiment, while the first wiper 51 is at the first cleaning position P3, the second wiper 52 is at the second cleaning position P4. That is, the time at which the cleaning solution 64 is applied to the first wiper 51 is the same as the time at which the cleaning solution 64 is applied to the second wiper 52.

In this preferred embodiment, the driver 75 (see FIG. 5) described later pivots the first wiper 51 at the first cleaning position P3 and the second wiper 52 at the second cleaning position P4 in the following manner. As illustrated in FIG. 8, in this example, a position above the liquid level 64A of the cleaning solution 64 stored in the cleaning solution tank 60 will be referred to as a cleaning solution non-immersion position PA, and a position below the cleaning solution non-immersion position PA and in the cleaning solution 64 will be referred to as a cleaning solution immersion position PB. Here, the driver 75 causes at least a portion of the first wiper 51 at the first cleaning position P3 to reciprocate a predetermined number of times between the cleaning solution non-immersion position PA and the cleaning solution immersion position PB, and to cause at least a portion of the second wiper 52 at the second cleaning position P4 to reciprocate the predetermined number of times between the cleaning solution non-immersion position PA and the cleaning solution immersion position PB. That is, the first wiper 51 and the second wiper 52 reciprocate multiple times (e.g., about twice to ten times) to pass through the liquid level 64A of the cleaning solution 64.

Figure 9:
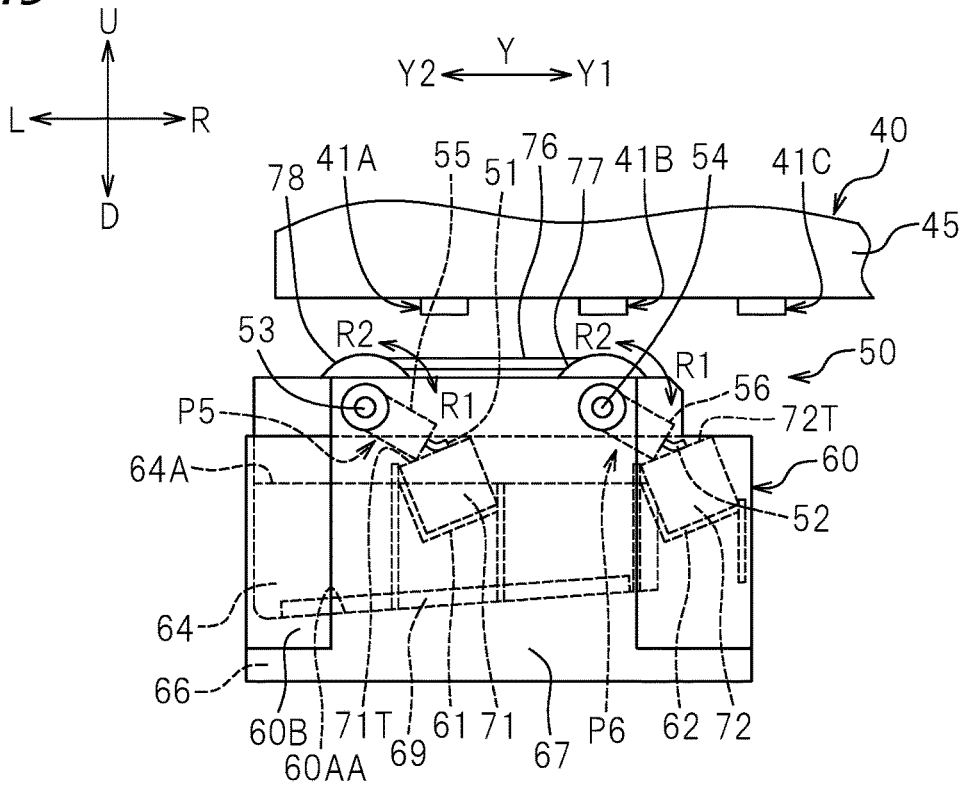
FIG. 9 is a schematic view illustrating positions of the first wiper and the second wiper at a first removing position and a second removing position.

As illustrated in FIG. 9, the first remover 71 removes the cleaning solution 64 remaining on the first wiper 51. The second remover 72 removes the cleaning solution 64 remaining on the second wiper 52. The first remover 71 is disposed between the first shaft 53 and the second shaft 54 in the main scanning direction Y. The second remover 72 is disposed at a side (right in this example) of the second shaft 54 opposite to the first remover 71. The first remover 71 is disposed in such a manner that an upper surface 71T of the first remover 71 faces the first shaft 53. That is, the first remover 71 tilts toward the lower left. The second remover 72 is disposed in such a manner that an upper surface 72T of the second remover 72 faces the second shaft 54. That is, the second remover 72 tilts toward the lower left. The first remover 71 and the second remover 72 are disposed in the cleaning solution tank 60, but are structured to prevent adherence of the cleaning solution 64 thereto. The upper surface 71T of the first remover 71 is located above the liquid level 64A of the cleaning solution 64. The upper surface 72T of the second remover 72 is located above the liquid level 64A of the cleaning solution 64. Each of the first remover 71 and the second remover 72 is made of a porous body capable of absorbing the cleaning solution 64. In this preferred embodiment, each of the first remover 71 and the second remover 72 includes a polyolefin sheet, for example. The polyolefin sheet has high absorbency and high solvent resistance. Thus, it is useful to use the polyolefin sheet as the first remover 71 and the second remover 72 that absorb the cleaning solution 64.

As illustrated in FIG. 9, the first wiper 51 contacts the first remover 71 at a first removing position P5. That is, the first wiper 51 is pushed against the first remover 71. By pushing the first wiper 51 against the first remover 71, the cleaning solution 64 remaining on the first wiper 51 is removed. The removed cleaning solution 64 is absorbed by the first remover 71. The first removing position P5 is an example of a "predetermined fifth position."

As illustrated in FIG. 9, the second wiper 52 contacts the second remover 72 at a second removing position P6. That is, the second wiper 52 is pushed against the second remover 72. By pushing the second wiper 52 against the second remover 72, the cleaning solution 64 remaining on the second wiper 52 is removed. The removed cleaning solution 64 is absorbed by the second remover 72. The second removing position P6 is an example of a "predetermined sixth position." In this preferred embodiment, while the first wiper 51 is at the first removing position P5, the second wiper 52 is at the second removing position P6. That is, the time when the cleaning solution 64 on the first wiper 51 is removed is the same as the time when the cleaning solution 64 on the second wiper 52 is removed.

The driver 75 moves the first wiper 51 and the second wiper 52. The driver 75 causes the first wiper 51 and the second wiper 52 to pivot to move the positions of the tips of the first wiper 51 and the second wiper 52. The driver 75 moves the first wiper 51 to at least the first wiping position P1 (see FIG. 6), the first cleaning position P3 (see FIG. 8), and the first removing position P5 (see FIG. 9). The driver 75 moves the second wiper 52 to at least the second wiping position P2 (see FIG. 7), the second cleaning position P4 (see FIG. 8), and the second removing position P6 (see FIG. 9).

As illustrated in FIG. 5, the driver 75 includes a driving pulley 77, a driven pulley 78, an endless belt 76, and a driving motor 79. The driven pulley 78 is disposed at the rear end of the first shaft 53. The driving pulley 77 is disposed at the rear end of the second shaft 54. The belt 76 is wound around the driving pulley 77 and the driven pulley 78. The driving motor 79 is connected to the driving pulley 77. Driving of the driving motor 79 causes the driving pulley 77 to rotate. With the rotation of the driving pulley 77, the second shaft 54 rotates to cause the second wiper 52 to pivot. In addition, with the rotation of the driving pulley 77, the belt 76 travels so that the driven pulley 78 rotates. With rotation of the driven pulley 78, the first shaft 53 rotates so that the first wiper 51 pivots. In this manner, the first wiper 51 and the second wiper 52 pivot in cooperation with each other. With the pivot of the first wiper 51, the first wiper moves to the first wiping position P1, the first cleaning position P3, and the first removing position P5. With the pivot of the second wiper 52, the second wiper 52 moves to the second wiping position P2, the second cleaning position P4, and the second removing position P6. In this preferred embodiment, the first wiper 51 and the second wiper 52 pivot to the same angle in cooperation with each other. Accordingly, while the first wiper 51 is at the first wiping position P1, the second wiper 52 is at the second wiping position P2. While the first wiper 51 is at the first cleaning position P3, the second wiper 52 is at the second cleaning position P4. While the first wiper 51 is at the first removing position P5, the second wiper 52 is at the second removing position P6. The driving pulley 77, the driven pulley 78, and the belt 76 are an example of a cooperation mechanism that causes the first wiper 51 and the second wiper 52 to pivot in cooperation with each other.

Next, a method for determining a wiper pitch WP (see FIG. 10) that is a distance between the first wiper 51 and the second wiper 52 will be described. More specifically, the WP is a distance with respect to the main scanning direction Y between a first end 51R of the first wiper 51 toward the second wiper 52 (i.e., the right end of the first wiper 51 in this example) while the first wiper 51 is at the first wiping position P1 and a second end 52R of the second wiper 52 opposite to the first wiper 51 (i.e., the right end of the second wiper 52 in this example) while the second wiper 52 is at the second wiping position P2. In this preferred embodiment, a "distance" refers to a distance in the main scanning direction Y.

Figure 10:
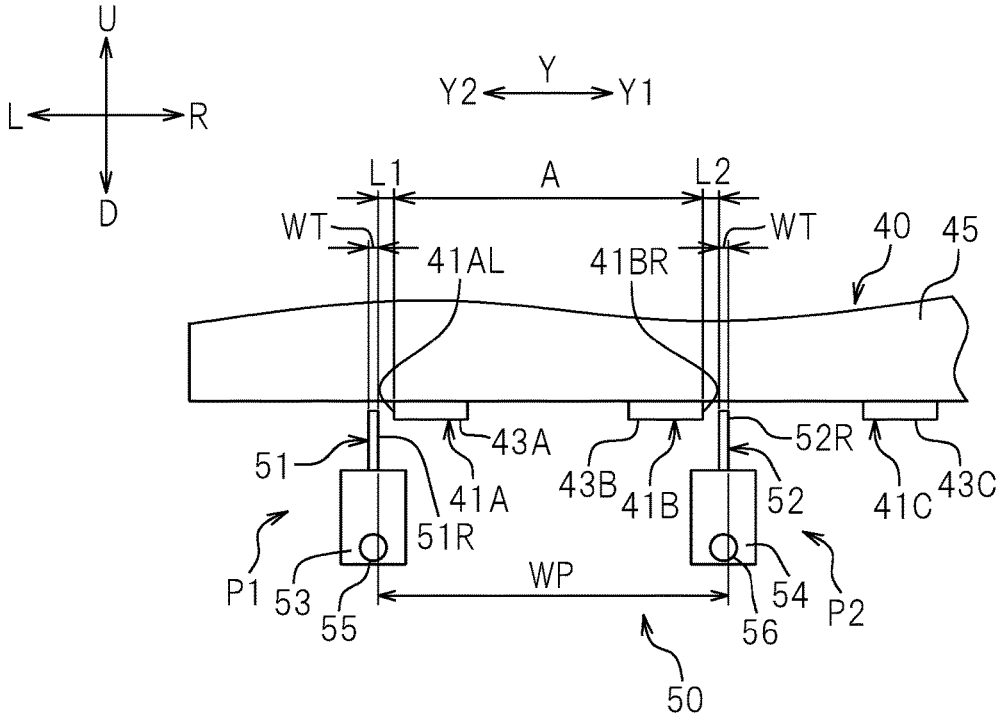
FIG. 10 is a schematic view illustrating a state in which a first ink head and a second ink head are located between the first wiper and the second wiper when the first wiper is located at the first wiping position and the second wiper is located at the second wiping position.

First, it is necessary for the first wiper 51 and the second wiper 52 not to interfere with the first ink head 41A and the second ink head 41B when the first wiper 51 and the second wiper 52 pivot. As illustrated in FIG. 10, Equation (1): $L1=L2=(WP-WT-A)/2>0$ (e.g., $L1=L2\geq 2$ mm) is satisfied, where L1 is a distance between the first wiper 51 and the first ink head 41A and L2 is a distance between the second wiper 52 and the second ink head 41B when the first wiper 51 is at the first wiping position P1, the second wiper 52 is at the second wiping position P2, and the first ink head 41A and the second ink head 41B are located between the first wiper 51 and the second wiper 52 in the main scanning direction Y. In addition, a WT is a thickness of the first wiper 51 in the main scanning direction Y when the first wiper 51 is at the first wiping position P1. Further, the WT is also a thickness of the second wiper 52 in the main scanning direction Y when the second wiper 52 is at the second wiping position P2.

Furthermore, A is a distance between a first head end 41AL of the first ink head 41A in the main scanning direction Y opposite to the second ink head 41B (i.e., the left end of the first ink head 41A in this example) and a second head end 41BR of the second ink head 41B in the main scanning direction Y opposite to the first ink head 41A (i.e., the right end of the second ink head 41B in this example).

Figure 11:
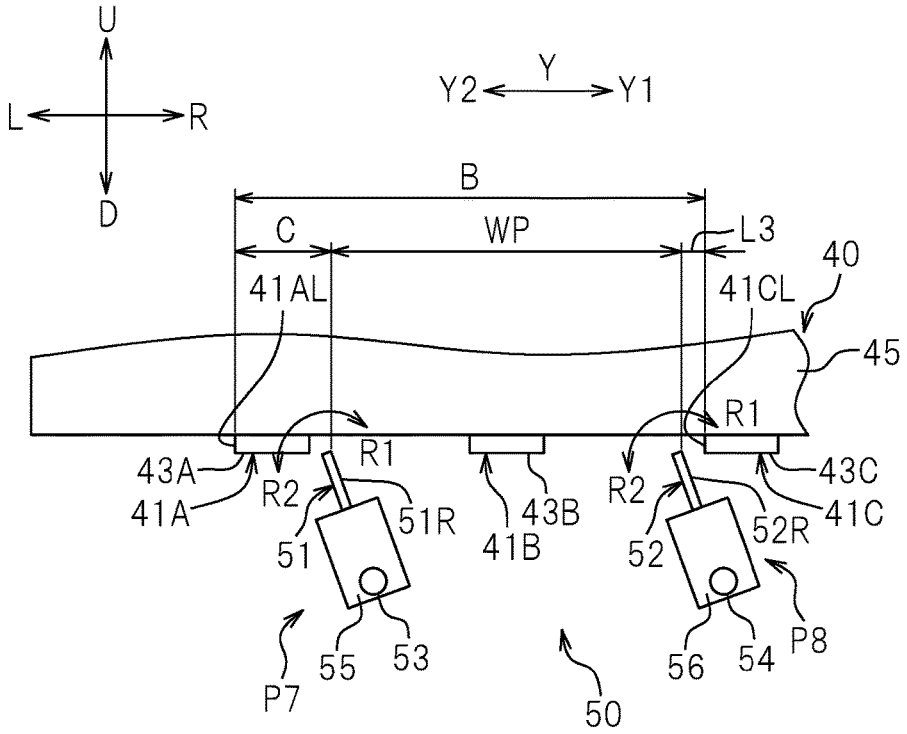
FIG. 11 is a schematic view illustrating a state after the first wiper has wiped the first nozzle surface of the first ink head.

It is also necessary for the second wiper 52 not to interfere with the second ink head 41B and the third ink head 41C when the first wiper 51 wipes the first nozzle surface 43A. As illustrated in FIG. 11, the driver 75 (see FIG. 5) moves the first wiper 51 to a first completion position P7 which is located between the first wiping position P1 and the first cleaning position P3 and at which the first wiper 51 has finished wiping of the first nozzle surface 43A and the second wiper 52 is closest to the third ink head 41C. The driver 75 (see FIG. 5) also moves the second wiper 52 to a second completion position P8 which is located between the second wiping position P2 and the second cleaning position P4 and at which the first wiper 51 has finished wiping of the first nozzle surface 43A and the second wiper 52 is closest to the third ink head 41C. Here, Equation (2): L3=(B−WP−C)>0 (e.g., L3≥2 mm) is satisfied, where L3 is a distance between the second end 52R of the second wiper 52 and a third head end 41CL of the third ink head 41C. In addition, B is a distance between the first head end 41AL of the first ink head 41A and a third head end 41CL (i.e., the left end of the third ink head 41C in this example) of the third ink head 41C in the main scanning direction Y toward the second ink head 41B. Furthermore, C is a distance between the first head end 41AL of the first ink head 41A and the first end 51R of the first wiper 51 at the first completion position P7.

Figure 12:
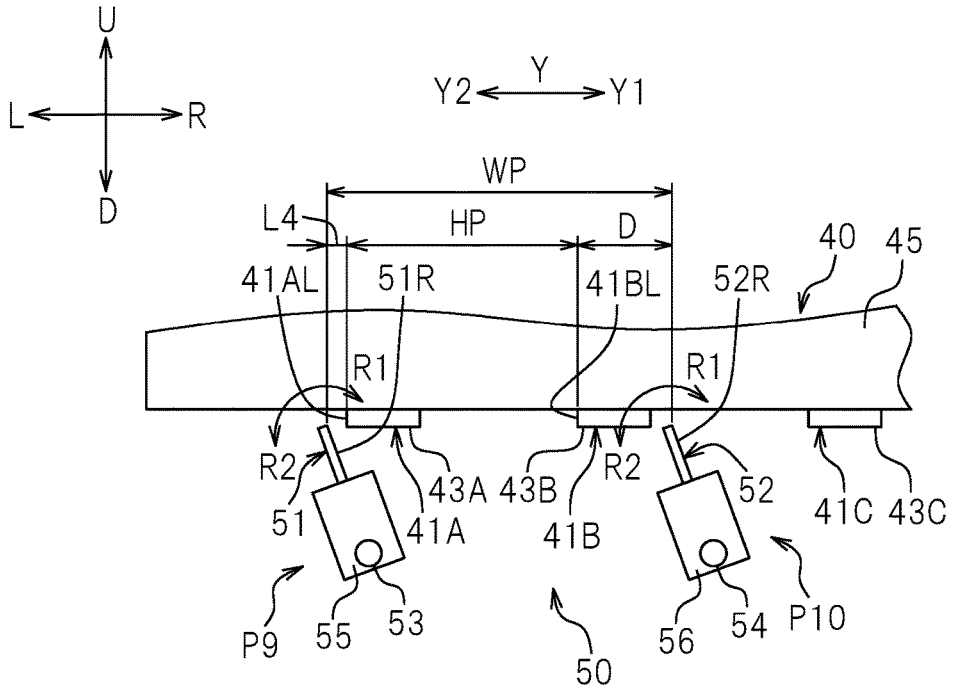
FIG. 12 is a schematic view illustrating a state after the second wiper has wiped the second nozzle surface of the second ink head.

It is also necessary for the first wiper 51 not to interfere with the first ink head 41A when the second wiper 52 wipes the second nozzle surface 43B. As illustrated in FIG. 12, the driver 75 (see FIG. 5) is configured to move the first wiper 51 to a third completion position P9 which is located between the first wiping position P1 and the first cleaning position P3 and at which the second wiper 52 has finished wiping of the second nozzle surface 43B and the first wiper 51 is closest to the first ink head 41A. The driver 75 (see FIG. 5) also moves the second wiper 52 to a fourth completion position P10 which is located between the second wiping position P2 and the second cleaning position P4 and at which the second wiper 52 has finished wiping of the second nozzle surface 43B and the first wiper 51 is closest to the first ink head 41A. Here, Equation (3): L4=(WP−HP−D)>0 (e.g., L4≥2 mm) is satisfied, where L4 is a distance between the first end 51R of the first wiper 51 and the first head end 41AL of the first ink head 41A. In this equation, HP is a distance between the first head end 41AL of the first ink head 41A and a fourth head end 41BL (i.e., the left end of the second ink head 41B in this example) of the second ink head 41B in the main scanning direction Y toward the first ink head 41A. In addition, D is a distance between the fourth head end 41BL of the second ink head 41B and the second end 52R of the second wiper 52 at the fourth completion position P10. In this preferred embodiment, the values of C and D are adjusted to be the same. In this preferred embodiment, the first completion position P7 and the third completion position P9 are the same, but may be different from each other. The second completion position P8 and the fourth completion position P10 are the same, but may be different from each other. When all Equations (1), (2), and (3) are satisfied, the wiper pitch WP is at an optimum value.

Next, the controller 80 will be described. The controller 80 is defined by a microcomputer, and is disposed inside the body 10A, for example. The controller 80 includes a CPU, and a ROM that stores programs to be executed by the CPU, and a RAM, for example. In this example, control concerning printing and control concerning wiping are performed by using programs stored in the microcomputer.

As illustrated in FIG. 3, the controller 80 is connected to the servo motor 24 connected to the pulley 21, the feed motor 81 connected to the grit rollers 26, the ink head unit 40, and the driving motor 79 of the driver 75 to drive the first wiper 51 and the second wiper 52, and controls the servo motor 24, the feed motor 81, the ink head unit 40, and the driving motor 79.

The controller 80 controls the servo motor 24 to control rotation of the pulley 21 and traveling of the belt 23 (see FIG. 2). That is, the controller 80 controls movement of the ink head unit 40 in the main scanning direction Y. The controller 80 controls, for example, times when the first ink head 41A through the eighth ink head 41H of the ink head unit 40 discharge ink. The controller 80 controls the driving motor 79 to control rotation of the driving pulley 77 and traveling of the belt 76. That is, the controller 80 controls the driving motor 79 to control movement of the first wiper 51 to the first wiping position P1, the first cleaning position P3, the first removing position P5, the first completion position P7, and the third completion position P9 and movement of the second wiper 52 to the second wiping position P2, the second cleaning position P4, the second removing position P6, the second completion position P8, and the fourth completion position P10.

The controller 80 controls the driver 75 to move, after the first wiper 51 has wiped the first nozzle surface 43A and the second wiper 52 has wiped the second nozzle surface 43B, the first wiper 51 to the first cleaning position P3 and the second wiper 52 to the second cleaning position P4. Thereafter, the controller 80 controls the driver 75 to move the first wiper 51 and the second wiper 52 to the first removing position P5 and the second removing position P6, respectively, and after the first wiper 51 has wiped the third nozzle surface 43C and the second wiper 52 has wiped the fourth nozzle surface 43D, to move the first wiper 51 and the second wiper 52 to the first cleaning position P3 and the second cleaning position P4, respectively. Subsequently, the controller 80 controls the driver 75 to move the first wiper 51 and the second wiper 52 to the first removing position P5 and the second removing position P6, respectively, and after the first wiper 51 has wiped the fifth nozzle surface 43E and the second wiper 52 has wiped the sixth nozzle surface 43F, to move the first wiper 51 and the second wiper 52 to the first cleaning position P3 and the second cleaning position P4, respectively. Then, the controller 80 controls the driver 75 to move the first wiper 51 and the second wiper 52 to the first removing position P5 and the second removing position P6, respectively, and after the first wiper 51 has wiped the seventh nozzle surface 43G and the second wiper 52 has wiped the eighth nozzle surface 43H, to move the first wiper 51 and the second wiper 52 to the first cleaning position P3 and the second cleaning position P4, respectively. As illustrated in FIG. 8, the controller 80 is configured to cause the driver 75 so that at least a portion of the first wiper 51 and at least a portion of the second wiper 52 to reciprocate a predetermined number of times between the cleaning solution non-immersion position PA and the cleaning solution immersion position PB.

Figure 13:
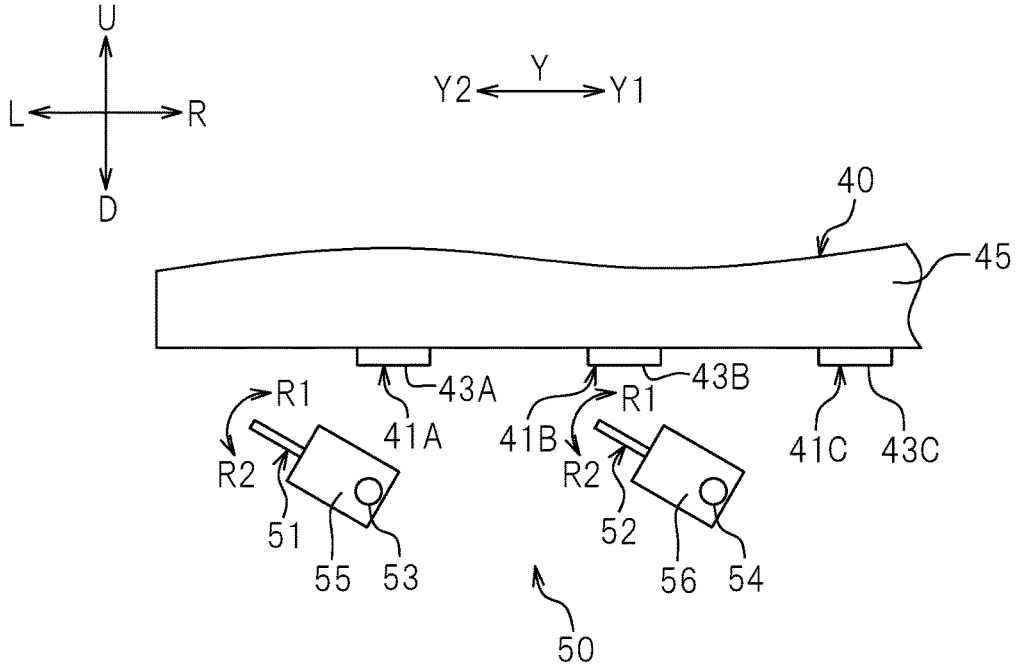
FIG. 13 is a schematic view illustrating a state of a wiping operation performed by the wiping unit.

A series of operations of wiping the first nozzle surface 43A through the eighth nozzle surface 43H of the first ink head 41A through the eighth ink head 41H by the first wiper 51 and the second wiper 52 of the wiping unit 50 will now be described. As illustrated in FIG. 8, before wiping by the wiping unit 50, the first wiper 51 and the second wiper 52 are at the cleaning solution immersion position PB at which the first wiper 51 and the second wiper 52 are immersed in the cleaning solution 64. Before wiping by the wiping unit 50 starts, the controller 80 moves the ink head unit 40 to above the wiping unit 50. Then, the driving motor 79 is driven to rotate the first wiper 51 and the second wiper 52 in the direction of arrow R1 in FIG. 8. At this time, the ink head unit 40 is moved in the direction of arrow Y1 in FIG. 8 so as to prevent the first wiper 51 and the second wiper 52 from contacting the first ink head 41A and the second ink head 41B. As illustrated in FIG. 9, at the first removing position P5, the first wiper 51 is pushed against the first remover 71 so that the cleaning solution 64 remaining on the first wiper 51 is removed. At this time, at the second removing position P6, the second wiper 52 is pushed against the second remover 72 so that the cleaning solution 64 remaining on the second wiper 52 is removed. Thereafter, the first wiper 51 and the second wiper 52 are rotated in the direction of arrow R2 in FIG. 9. Subsequently, the ink head unit 40 is moved in the direction of arrow Y2 in FIG. 9 so that the first ink head 41A is located above the first shaft 53 (see FIG. 13). Then, the first wiper 51 and the second wiper 52 are rotated in the direction of arrow R1 in FIG. 13, and as illustrated in FIG. 6, the first wiper 51 is moved to the first wiping position P1. Thereafter, the ink head unit 40 is moved in the direction of arrow Y1 in FIG. 6, and the first nozzle surface 43A is wiped by the first wiper 51. Immediately before the first wiper 51 leaves the first nozzle surface 43A, the first wiper 51 is rotated in the direction of arrow R2 in FIG. 6 to be tilted. Accordingly, when the first wiper 51 leaves from the first nozzle surface 43A, it is possible to prevent ink or other substances from spattering from the first wiper 51 (see FIG. 11).

Figure 14:
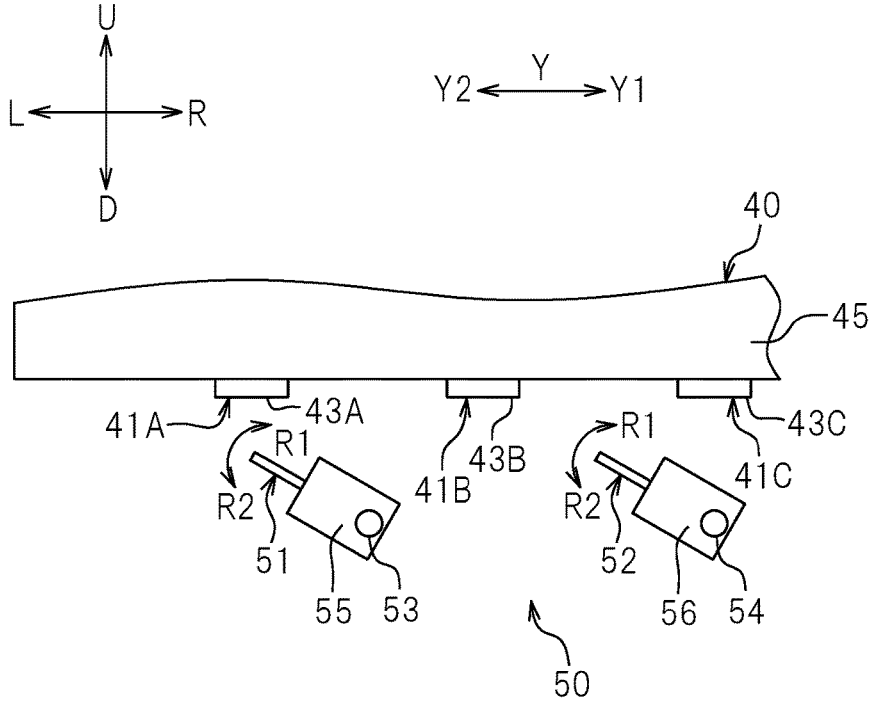
FIG. 14 is a schematic view illustrating a state of the wiping operation performed by the wiping unit.
Figure 15:
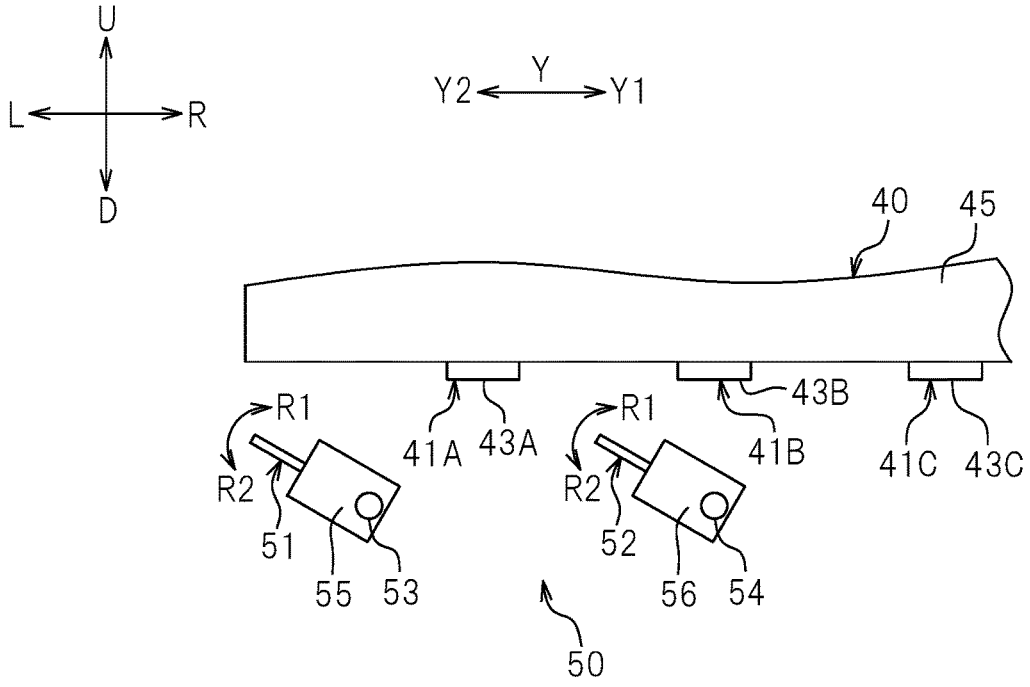
FIG. 15 is a schematic view illustrating a state of the wiping operation performed by the wiping unit.

Then, the first wiper 51 and the second wiper 52 are rotated in the direction of arrow R2 in FIG. 11, and the ink head unit 40 is moved in the direction of arrow Y2 in FIG. 11 (see FIG. 14). Thereafter, the ink head unit 40 is moved in the direction of arrow Y1 in FIG. 14 in such a manner that the second ink head 41B is located above the second shaft 54 (see FIG. 15). Subsequently, the first wiper 51 and the second wiper 52 are rotated in the direction of arrow R1 in FIG. 15, and as illustrated in FIG. 7, the second wiper 52 is moved to the second wiping position P2. Then, the ink head unit 40 is moved in the direction of arrow Y1 in FIG. 7, and the second nozzle surface 43B is wiped by the second wiper 52. Immediately after the second wiper 52 leaves from the second nozzle surface 43B, the second wiper 52 is rotated in the direction of arrow R2 in FIG. 7 to be tilted. Accordingly, when the second wiper 52 leaves from the second nozzle surface 43B, it is possible to prevent ink or other substances from spattering from the second wiper 52 (see FIG. 12). When wiping of the first nozzle surface 43A by the first wiper 51 and wiping of the second nozzle surface 43B by the second wiper 52 are finished, the first wiper 51 and the second wiper 52 are rotated in the direction of arrow R2 in FIG. 15, the ink head unit 40 is moved in the direction of arrow Y2 in FIG. 15, and the first wiper 51 and the second wiper 52 are moved to the cleaning solution immersion position PB. Accordingly, the first wiper 51 and the second wiper 52 are cleaned. In a manner similar to the wiping of the first nozzle surface 43A and the second nozzle surface 43B, the fourth nozzle surface 43D is wiped by the second wiper 52 together with wiping of the third nozzle surface 43C by the first wiper 51, the sixth nozzle surface 43F is wiped by the second wiper 52 together with wiping of the fifth nozzle surface 43E by the first wiper 51, and the eighth nozzle surface 43H is wiped by the second wiper 52 together with wiping of the seventh nozzle surface 43G by the first wiper 51. In this manner, a wiping operation performed by the wiping unit is completed.

In the printer 10 according to this preferred embodiment, the first ink head 41A, the third ink head 41C, the fifth ink head 41E, and the seventh ink head 41G (hereinafter collectively referred to as a "first ink head group") are arranged at the same position in the sub-scanning direction X, the second ink head 41B, the fourth ink head 41D, the sixth ink head 41F, and the eighth ink head 41H (hereinafter collectively referred to as a "second ink head group") are arranged at the same position in the sub-scanning direction X. The first ink head group and the second ink head group are shifted from each other in the sub-scanning direction X. In this example, the printer 10 includes the first wiper 51 for wiping the first nozzle surface 43A, the third nozzle surface 43C, the fifth nozzle surface 43E, and the seventh nozzle surface 43G and the second wiper 52 for wiping the second nozzle surface 43B, the fourth nozzle surface 43D, the sixth nozzle surface 43F, and the eighth nozzle surface 43H, thus ensuring wiping of the nozzle surfaces 43A through 43H. In the case of providing a single wiper that is relatively long in the sub-scanning direction X enough to wipe the first nozzle surface 43A through the eighth nozzle surface 43H, the wiper needs to be immersed in the cleaning solution for every wiping of the nozzle surfaces 43A through 43H, and the step of removing the cleaning solution is needed for every wiping. Thus, as the number of ink heads increases, the time necessary for wiping increases. On the other hand, in the case of including the first wiper 51 and the second wiper 52, since the first wiper 51 and the second wiper 52 pivot by the same angle, in supplying the cleaning solution 64 to the first wiper 51, the cleaning solution 64 is supplied to the second wiper 52 at the same time. In removing the cleaning solution 64 remaining on the first wiper 51, the cleaning solution 64 remaining on the second wiper 52 is removed at the same time. Thus, the time necessary for wiping is reduced, as compared to the case of including a single wiper.

In the printer 10 according to this preferred embodiment, the first remover 71 is disposed between the first shaft 53 and the second shaft 54 in the sub-scanning direction X, and the second remover 72 is disposed at the side of the second shaft 54 opposite to the first remover 71. Accordingly, the cleaning solution 64 remaining on the first wiper 51 and the second wiper 52 is able to be easily removed.

In the printer 10 according to this preferred embodiment, as illustrated in FIG. 10, $L1=L2=(WP-WT-A)/2>0$ is satisfied. Accordingly, interference of the first wiper 51 and the second wiper 52 with the first ink head 41A through the eighth ink head 41H is reduced or prevented.

In the printer 10 according to this preferred embodiment, as illustrated in FIG. 11, $L3=(B-WP-C)>0$ is satisfied. Accordingly, interference of the first wiper 51 and the second wiper 52 with the first ink head 41A through the eighth ink head 41H is reduced.

In the printer 10 according to this preferred embodiment, $L4=(WP-HP-D)>0$ is satisfied. Accordingly, interference of the first wiper 51 and the second wiper 52 with the first ink head 41A through the eighth ink head 41H is significantly reduced or prevented.

In the printer 10 according to this preferred embodiment, the controller 80 controls the driver 75 to move, after the first wiper 51 has wiped the first nozzle surface 43A and the second wiper 52 has wiped the second nozzle surface 43B, the first wiper 51 to the first cleaning position P3 and the second wiper 52 to the second cleaning position P4. Accordingly, wiping of the first nozzle surface 43A and the second nozzle surface 43B is able to be more quickly completed.

In the printer 10 according to this preferred embodiment, the controller 80 controls the driver 75 to cause at least a portion of the first wiper 51 and at least a portion of the second wiper 52 to reciprocate a predetermined first number of times between the cleaning solution non-immersion position PA and the cleaning solution immersion position PB. Accordingly, cleaning of the first wiper 51 and the second wiper 52 is more effectively performed.

In the printer 10 according to this preferred embodiment, the filter 69 is disposed on the upper surface 60AA of the bottom wall 60A of the cleaning solution tank 60. Adherents to the first wiper 51 and the second wiper 52 are removed with the cleaning solution 64 in the cleaning solution tank 60. The removed adherents are precipitated in the cleaning solution 64 and adhere to the filter 69. Thus, a simple method of taking the filter 69 with adherents out of the cleaning solution tank 60 is able to clean the inside of the cleaning solution tank 60.

In the printer 10 according to this preferred embodiment, the wiping unit 50 includes the driven pulley 78 disposed at the rear end of the first shaft 53, the driving pulley 77 disposed at the rear end of the second shaft 54, the driving motor 79 connected to the driving pulley 77, and the belt 76 wound around the driving pulley 77 and the driven pulley 78 and causing the first wiper 51 and the second wiper 52 to operate in cooperation with each other. In this manner, the use of the single driving motor 79 enables the first wiper 51 and the second wiper 52 to pivot, and thus, the first wiper 51 and the second wiper 52 are able to be easily controlled.

In the printer 10 according to this preferred embodiment, each of the first remover 71 and the second remover 72 is a porous body capable of absorbing the cleaning solution. In this preferred embodiment, the porous body is made of a polyolefin sheet. This eases removal of the cleaning solution 64 remaining on the first wiper 51 and the second wiper 52.

In the preferred embodiment described above, the first remover 71 is disposed between the first shaft 53 and the second shaft 54 in the main scanning direction Y, and the second remover 72 is disposed at the side of the second shaft 54 opposite to the first remover 71 (the right side in this example). The present invention, however, is not limited to this example. For example, the second remover 72 may be disposed between the first shaft 53 and the second shaft 54 in the main scanning direction Y, and the first remover 71 may be disposed at the side of the first shaft 53 opposite to the second remover 72 (the left side in this example).

In the preferred embodiment described above, at the first cleaning position P3, the first wiper 51 reciprocates between the cleaning solution non-immersion position PA and the cleaning solution immersion position PB. Alternatively, the first wiper 51 may reciprocate between places at a predetermined distance while being immersed in the cleaning solution 64. Although the second wiper 52 reciprocates between the cleaning solution non-immersion position PA and the cleaning solution immersion position PB at the at the second cleaning position P4, an operation of causing the second wiper 52 to reciprocate between places at a predetermined distance may be performed with the second wiper 52 being immersed in the cleaning solution 64.

In the preferred embodiment described above, the first nozzle surface 43A and the second nozzle surface 43B are wiped first, the third nozzle surface 43C and the fourth nozzle surface 43D are wiped second, the fifth nozzle surface 43E and the sixth nozzle surface 43F are wiped third, and the seventh nozzle surface 43G and the eighth nozzle surface 43H are wiped last. However, wiping is not limited to a specific order as long as the combinations described above are employed.

The front ends of the second ink head 41B, the fourth ink head 41D, the sixth ink head 41F, and the eighth ink head 41H may be located behind the front ends of the first ink head 41A, the third ink head 41C, the fifth ink head 41E, and the seventh ink head 41G and ahead of the rear ends of the first ink head 41A, the third ink head 41C, the fifth ink head 41E, and the seventh ink head 41G. In this case, the front end of the first wiper 51 is located ahead of the front end of the second wiper 52.

In the preferred embodiments described above, the driving motor 79 is the first driver to cause the first wiper 51 to pivot and the second driver to cause the second wiper 52 to pivot. The present invention, however, is not limited to this example. The driving motor 79 may be used to cause only one of the first wiper 51 and the second wiper 52 to pivot with the other wiper being caused to pivot by another driving motor. Accordingly, the first wiper 51 and the second wiper 52 are able be controlled independently of each other.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet printer comprising:

a first ink head including a plurality of first nozzles arranged in a first direction and a first nozzle surface on which the first nozzles are disposed;

a second ink head disposed at a side of the first ink head in a second direction perpendicular or substantially perpendicular to the first direction, the second ink head including a plurality of second nozzles arranged in the first direction and a second nozzle surface on which the second nozzles are disposed, a portion of the second nozzles being disposed at a position identical to a portion of the first nozzles in the first direction, the second ink head being shifted from the first ink head in the first direction;

a third ink head disposed at a side of the second ink head opposite to the first ink head in the second direction and at a position identical to a position of the first ink head in the first direction, the third ink head including a plurality of third nozzles arranged in the first direction and a third nozzle surface on which the third nozzles are disposed, the third nozzles being disposed at a position identical to a position of the first nozzles in the first direction;

a fourth ink head disposed at a side of the third ink head opposite to the second ink head in the second direction and at a position identical to a position of the second ink head in the first direction, the fourth ink head including a plurality of fourth nozzles arranged in the first direction and a fourth nozzle surface on which the fourth nozzles are disposed, a portion of the fourth nozzles being disposed at a position identical to the position of the second nozzles in the first direction;

a first wiper that extends in the first direction and wipes the first nozzle surface and the third nozzle surface, and does not wipe the second nozzle surface and the fourth nozzle surface, at a predetermined first position;

a second wiper that extends in the first direction, is disposed at a side of the first wiper in the second direction and is disposed partially at a position identical to a position of the first wiper in the first direction, pivots to an angle identical to an angle of the first wiper and wipes the second nozzle surface and the fourth nozzle surface, and does not wipe the first nozzle surface and the third nozzle surface, at a predetermined second position;

a cleaner that supplies a cleaning solution to the first wiper at a predetermined third position and supplies the cleaning solution to the second wiper at a predetermined fourth position at an identical time;

a remover that removes the cleaning solution remaining on the first wiper at a predetermined fifth position and removes the cleaning solution remaining on the second wiper at a predetermined sixth position at an identical time;

a first driver that moves the first wiper to the first position, the third position, and the fifth position; and a second driver that moves the second wiper to the second position, the fourth position, and the sixth position.

2. The ink jet printer according to claim 1, further comprising:

a first shaft that pivotably supports the first wiper; and a second shaft that is separated from the first shaft and pivotably supports the second wiper; wherein the remover includes a first remover that is located between the first shaft and the second shaft in the second direction and removes the cleaning solution remaining on the first wiper and a second remover that is located at a side of the second shaft opposite to the first remover and removes the cleaning solution remaining on the second wiper.

3. The ink jet printer according to claim 1, further comprising:

a first shaft that pivotably supports the first wiper; and a second shaft that is separated from the first shaft and pivotably supports the second wiper; wherein the remover includes a first remover that is located between the first shaft and the second shaft in the second direction and removes the cleaning solution remaining on the second wiper and a second remover that is located at a side of the first shaft opposite to the first remover and removes the cleaning solution remaining on the first wiper.

4. The ink jet printer according to claim 1, wherein $L1=L2=(WP-WT-A)/2>0$ is satisfied; wherein WP is a distance in the second direction between a first end of the first wiper toward the second wiper when the first wiper is at the first position and a second end of the second wiper opposite to the first wiper when the second wiper is at the second position;

WT is a thickness of the first wiper in the second direction when the first wiper is at the first position;

A is a distance between a first head end of the first ink head in the second direction opposite to the second ink head and a second head end of the second ink head in the second direction opposite to the first ink head; and L1 is a distance between the first wiper and the first ink head and L2 is a distance between the second wiper and the second ink head when the first wiper is at the first position, the second wiper is at the second position, and the first ink head and the second ink head are between the first wiper and the second wiper in the second direction.

5. The ink jet printer according to claim 4, wherein the first driver moves the first wiper to a seventh position which is located between the first position and the third position and at which the first wiper has finished wiping of the first nozzle surface and the second wiper is closest to the third ink head;

the second driver moves the second wiper to an eighth position which is located between the second position and the fourth position and at which the first wiper has finished wiping of the first nozzle surface and the second wiper is closest to the third ink head; and $L3=(B-WP-C)>0$ is satisfied; wherein B is a distance between the first head end and a third head end of the third ink head in the second direction toward the second ink head;

C is a distance between the first head end of the first ink head and the first end of the first wiper at the seventh position; and L3 is a distance between the second end of the second wiper and the third head end of the third ink head.

6. The ink jet printer according to claim 5, wherein the first driver moves the first wiper to a ninth position which is located between the first position and the third position and at which the second wiper has finished wiping of the second nozzle surface and the first wiper is closest to the first ink head;

the second driver moves the second wiper to a tenth position which is located between the second position and the fourth position and at which the second wiper has finished wiping of the second nozzle surface and the first wiper is closest to the first ink head; and $L4=(WP-HP-D)>0$ is satisfied; wherein HP is a distance between the first head end and a fourth head end of the second ink head in the second direction toward the first ink head;

D is a distance between the fourth head end of the second ink head and the second end of the second wiper in the tenth position; and L4 is a distance between the first end of the first wiper and the first head end of the first ink head.

7. The ink jet printer according to claim 1, further comprising:

a controller connected to the first driver and the second driver; wherein the controller controls the first driver to move the first wiper to the third position and controls the second driver to move the second wiper to the fourth position, after the first wiper has wiped the first nozzle surface and the second wiper has wiped the second nozzle surface.

8. The ink jet printer according to claim 7, wherein the cleaner includes a cleaning solution tank that stores the cleaning solution; and assuming a position above a liquid level of the cleaning solution stored in the cleaning solution tank is a cleaning solution non-immersion position and a position below the liquid level of the cleaning solution stored in the cleaning solution tank is a cleaning solution immersion position, the controller controls the first driver and the second driver so that at least a portion of the first wiper and at least a portion of the second wiper reciprocate a first number of times between the cleaning solution non-immersion position and the cleaning solution immersion position.

9. The ink jet printer according to claim 1, wherein the cleaner includes a cleaning solution tank that stores the cleaning solution; and a filter is disposed on an upper surface of a bottom wall of the cleaning solution tank.

10. The ink jet printer according to claim 1, wherein the first driver is identical to the second driver; and the ink jet printer further comprises a pivot controller that causes the first wiper and the second wiper to pivot in cooperation with each other.

11. The ink jet printer according to claim 1, wherein the remover includes a porous body capable of absorbing a cleaning solution.

* * * * *